US005315829A

United States Patent [19]

Fischer

[11] Patent Number: 5,315,829

[45] Date of Patent: May 31, 1994

[54] HYDRAULIC SYSTEM FOR HYDRAULIC OPERATORS

[75] Inventor: Helmut Fischer, Gründau/Lieblos, Fed. Rep. of Germany

[73] Assignee: Mannesmann Rexroth GmbH, Lohr/Main, Fed. Rep. of Germany

[21] Appl. No.: 990,119

[22] Filed: Dec. 14, 1992

[30] Foreign Application Priority Data

Dec. 16, 1991 [DE] Fed. Rep. of Germany ..... 4141492

[51] Int. Cl.[5] ..... F16D 31/02

[52] U.S. Cl. ..... 60/456; 60/422; 60/445; 123/41.12

[58] Field of Search ..... 60/422, 445, 456; 123/41.12

[56] References Cited

U.S. PATENT DOCUMENTS

| | | | |
|---|---|---|---|
| 4,011,721 | 3/1977 | Yip | 60/445 |
| 4,065,922 | 1/1978 | Ot et al. | 60/445 |
| 4,223,646 | 9/1980 | Kinder | 60/456 |
| 4,487,255 | 12/1984 | Bianchetta et al. | 123/41.12 |

FOREIGN PATENT DOCUMENTS

| | | |
|---|---|---|
| 3410071 | 10/1985 | Fed. Rep. of Germany . |
| 3538643 | 5/1987 | Fed. Rep. of Germany . |
| 3834201 | 11/1989 | Fed. Rep. of Germany . |
| 3844403 | 7/1990 | Fed. Rep. of Germany . |

*Primary Examiner*—Edward K. Look
*Assistant Examiner*—F. Daniel Lopez
*Attorney, Agent, or Firm*—Emrich & Dithmar

[57] ABSTRACT

The invention relates to a hydraulic system for hydraulic operators for delivering pressurized fluid to a blower drive means and to the hydraulic operators of a hydraulic machine, comprising a variable delivery pump, control valves connecting the hydraulic operators and the blower drive means to the pump, a temperature responsive pressure valve for setting a temperature-proportional control pressure in the pressure line between the blower drive means and the respective control valve, wherein the control valve is subjected to the pressure in the control line in a sense to open the control valve, and a flow volume regulator associated to the variable delivery pump which regulator is subjected via a load sensing line by the load pressure occuring at the hydraulic operators or in the blower drive means depending on which pressure is higher.

6 Claims, 2 Drawing Sheets

HYDRAULIC SYSTEM FOR HYDRAULIC OPERATORS

DESCRIPTION

Figure 1:
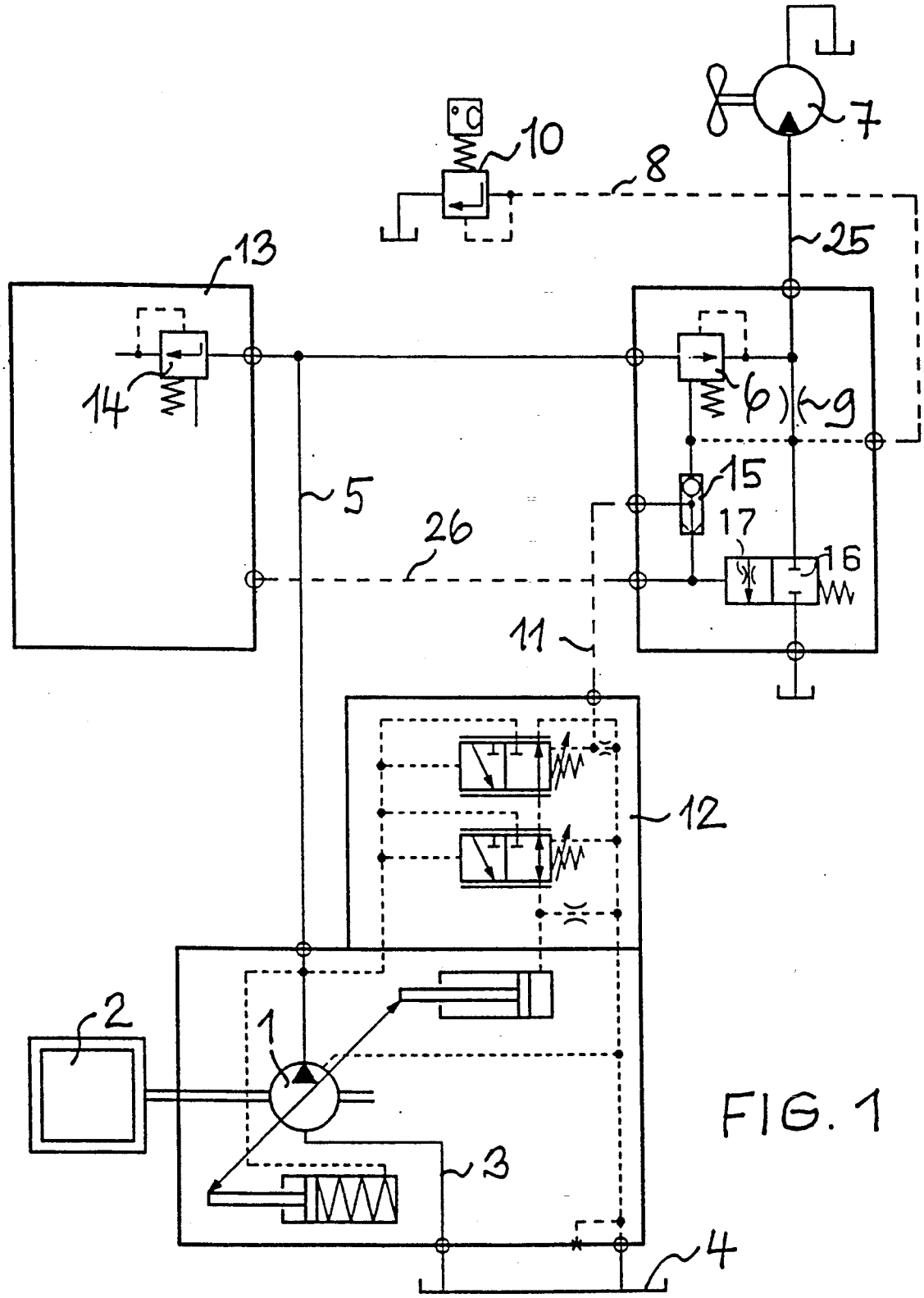

The present invention relates to a hydraulic system for hydraulic operators according to the preamble of claim 1.

According to a conventional engineering, a number of hydraulic pumps, i.e. constant delivery pumps are provided to deliver hydraulic fluid to the hydraulic operators as well as to a hydraulic motor for driving the blower of the internal combustion engine in hydraulic machinery such as community machinery, loaders, tippers and so on, all comprising an internal combustion engine as primary energy source.

German 34 10 071 discloses a central variable delivery pump delivering a flow volume of hydraulic fluid which is distributed by a priority valve to the hydraulic operators and the blower drive means. The priority valve is controlled by the pressure in the hydraulic operator circuit. A throttle valve is provided in the blower circuit which throttle valve is controlled in response to temperature. The respective higher pressure either occuring in the hydraulic operator circuit or the blower drive circuit is applied to the regulator of the variable delivery pump.

Furthermore, it is known to the artisan (without presenting a printed reference) to deliver the hydraulic fluid of a variable displacement pump through a pressure compensating valve each to a pair of hydraulic circuits. Still further, temperature responsive pressure valves are known to connect a control pressure line to the reservoir in response to temperature such that a control pressure proportional to the prevailing temperature may be set in the control pressure line.

The object of the present invention is to provide a hydraulic system which is able to supply a maximum fluid volume to the hydraulic operators when needed, while on the other side the blower drive circuit receives a sufficient volume of hydraulic fluid to maintain a certain temperature, in particular for the internal combustion engine.

According to the invention, the object referred to is solved by the features listed in claim 1.

As soon as a hydraulic operator is actuated, the load pressure occuring therewith, even very small, is supplied to the load sensing line to actuate a control valve such that the control pressure acting on the control valve in a sense to open it, is reduced such that the flow volume which is applied to the blower drive means is diminished so that the blower motor turns at a constant speed which is less than the speed which is provided when the hydraulic operator is not actuated. Accordingly the speed of the blower is adjusted to a minimum independently of the load pressure occuring in the hydraulic operators, which constant speed thus limits the maximum speed of the blower. Accordingly all the residual volume of hydraulic fluid is available to the hydraulic operator circuit, while the constant speed of the blower provides a sufficient cooling of the engine.

Further aspects of the present invention are characterized in the subclaims. Accordingly, the control valve may be defined by a pressure compensating valve or a proportional directional valve. With the latter, a priority arrangement is obtained which makes it safely possible that the cooling circuit of the engine receives hydraulic fluid with priority, even under different load pressures of the hydraulic operator circuit.

Figure 2:
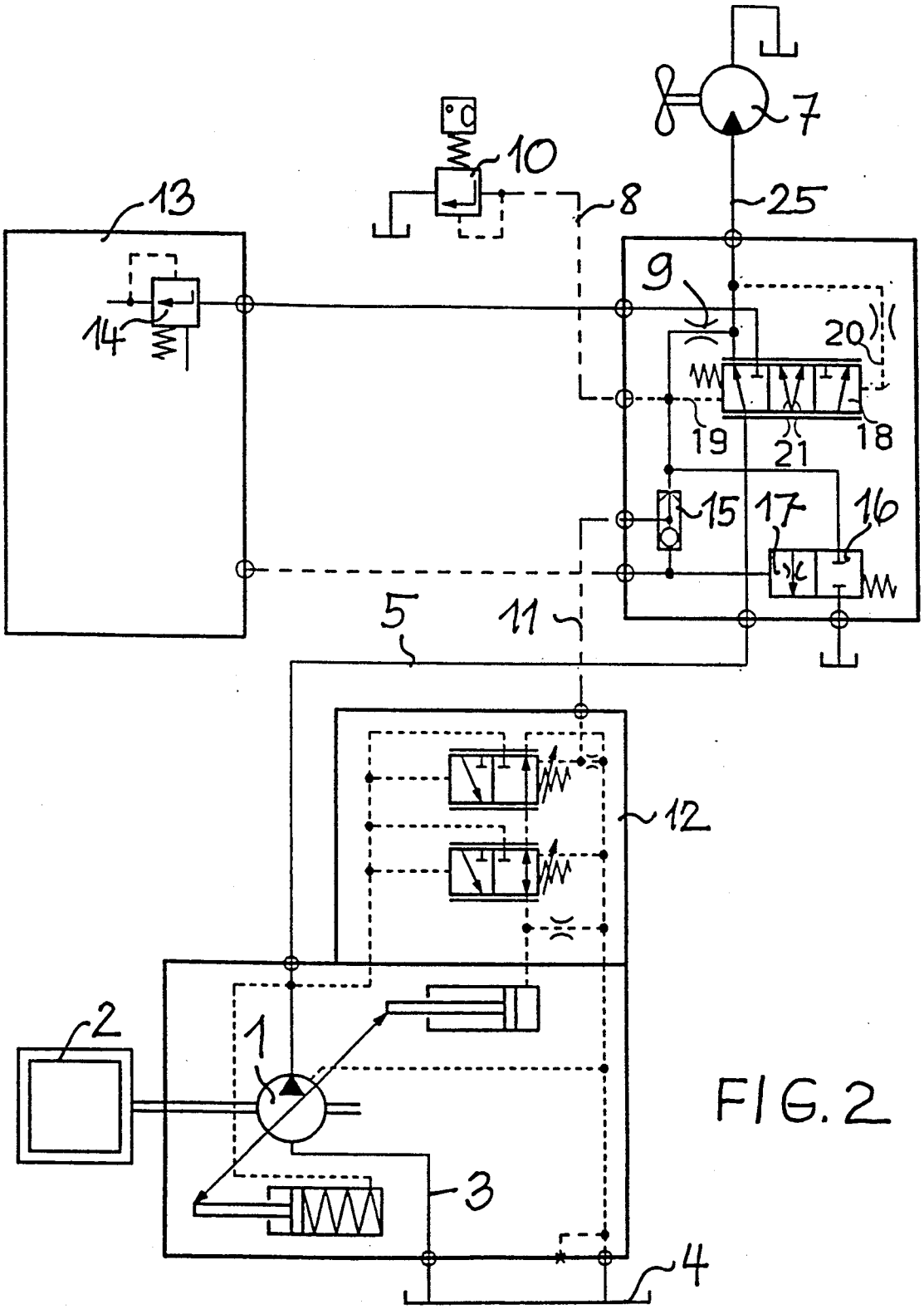

An embodiment of the present invention is in detail described as follows with reference to an illustration. The drawings show:

FIG. 1 a first embodiment of the hydraulic system according to the invention including a pressure compensating valve arranged in the pressure line leading to the blower drive means, FIG. 2 an alternative embodiment including a priority valve arranged in the pressure line leading to the blower drive means.

The system comprises a variable displacement pump 1 including a pressure/flow volume regulator 12 which is conventional. The pump 1 is directly driven by the engine 2. The variable displacement pump 1 draws fluid through a line 3 from the reservoir 4 and delivers the pressurized fluid into a pressure line 5. The pressure line 5 is connected through a control valve 6, 14 each to a blower drive means 7 and a hydraulic operator 13.

As is apparent from FIG. 1, the hydraulic fluid flows through a 2-way pressure compensating valve 6 and a pressure line 25 directly to the blower drive means 7, i.e. a hydraulic motor driving the blower wheel located in front of the cooler of an internal combustion engine. In response to the pressure thus occuring in the pressure line 25, the blower characteristic results in a certain speed of the blower wheel. It should be remembered that the quradrature of the speed is proportional to the pressure in the pressure line 25.

To provide a temperature responsive control, the control pressure line 8 is connected through an orifice 9 to the pressure line 25. The temperature responsive pressure valve 10 sets a control pressure in the line 8 which control pressure is proportional to the temperature of the cooling water in the cooling system of an engine. The control pressure in the line 8 acts in the spring chamber of the pressure compensating valve to move the valve member of the pressure compensating valve in a sense to open it, while the load pressure in the pressure line 25 acts on the valve member in opposition thereto in a sense to close the valve. It will be realized by the artisan that the illustration of the valves corresponds to international standards.

When the temperature increases this is noticed by the valve 10 to increase the control pressure in the line 8. Accordingly the pressure compensating valve 6 is further opened to deliver a larger flow of fluid to the blower motor 7 to increase the blower speed.

Still further, the control pressure is applied through the shuttle valve 15 and the load sensing line 11 to the pump regulator 12. As the regulator 12 is conventional, it is not deemed necessary to describe the structure and operation thereof. It should be sufficient to say that the pressure in line 11 causes to adjust the variable displacement pump 1 such that the pump delivers the volume of fluid which is necessary to obtain this particular pressure in the pressure line 25. It should be noted that any throttling losses in the blower circuit are reduced to a minimum, i.e. just to the pressure drop across the pressure compensating valve 6. It should be further noted that no throttling losses whatsoever occur when the blower is operated alone since the pressure compensating valve is completely open in this case. Then control is merely performed by means of the control line 11 leading to the regulator 12.

Parallel to the blower circuit, the pump line 5 delivers pressurized fluid to the hydraulic operator 13. Conventionally, the operator circuit 13 comprises a number of directional valves (not shown) to connect respective operating cylinders and/or hydraulic motors (not shown) to the pressure line 5. Upstream of each directional valve there is a pressure compensating valve 14 cooperating with the respective directional valve in a conventional manner to obtain a flow volume control which means that the flow volume to the cylinder is adjusted such that a certain moving speed of the cylinder is maintained irrespective of the load acting on the cylinder. The load pressures occuring when the hydraulic operators are actuated are sensed at the directional valves, and each individual load sensing line (not shown) is connected through a shuttle valve chain (not shown) to the common load sensing line 26. As this load sensing system is conventional it is not shown nor described in detail. It suffices to say that the highest load pressure which occurs at a particular operator at a time is applied through the shuttle valve chain to the load sensing line 26. FIG. 1 shows that line 26 is connected to the shuttle valve 15. Accordingly, the shuttle valve 15 selects either the pressure in the blower circuit or in the operator circuit 13, whatever pressure is the higher, and delivers this pressure through the line 11 to the regulator 12 of the pump 1. When both the blower motor and the hydraulic operator are actuated together the pressure compensating valves 6 and 14 primarily serve to reduce the pump pressure to the pressure level required.

FIG. 1 further shows a 2/2-way control pressure valve 16 through which the control pressure line 8 may be connected to the reservoir through an orifice 17. The valve 16 closes under the action of the spring, while the load pressure in the load sensing line 26 tends to open the valve. Accordingly when the operator circuit 13 is actuated, the valve 16 opens even under a very small load pressure occuring in the operator circuit. Accordingly, the valve 16 is immediately opened to diminish the control pressure in the line 8 through the orifice 17, the fluid returning to the reservoir. From this results that the pressure compensating valve 6 moves towards the closing position such that the speed of the blower motor 7 is diminished to a value which is less compared with the pressure prevailing in the case that the operator circuit 13 is not acutated. Accordingly the blower motor rotates at a constant minimum speed which is independently of the operator load so that the highest possible flow volume is available to the operator circuit 13. The internal combustion engine should not overheat when the minimum speed is properly set and under the aspect that the hydraulic circuit is actuated on a short duty base as it is usually the case.

In the embodiment shown in FIG. 2, the pressure compensating valve 6 is replaced by a 3/3-way directional proportional valve 18. Again the valve 18 is controlled by the temperature responsive pressure of the blower circuit so that the cooling system of the engine is supplied under priority with fluid. The control pressure set by the temperature responsive pressure valve 10 in the control pressure line 8 is fed via the branch line 19 to the valve piston of the valve 18 such that it is positioned in the position shown in which the pump line 5 is connected to the pressure line 25 of the blower motor 7. The pressure in the pressure line 25 is fed through a branch line 20 to the valve 18 such that it is actuated to move from the end position shown across an operating range of variable flow cross sections 21 into an opposite end position in which the hydraulic operator circuit 13 alone is supplied with fluid. Thus the fluid is distributed between the blower circuit and the operator circuit 13 in this working range according to the aspect of priority. Should the case occur that the volume delivered by the variable displacement pump 1 is not sufficient to feed both circuits, the fluid would regularly flow towards the circuit having the smaller pressure.

However, the priority valve 18 in combination with the valve 16 prevents an overheating of the engine even when the operator circuit is excessively operated and when the cooling water temperature of the engine is high, since the blower motor 7 receives a proper fluid volume in any case.

It is noted that throttling losses across the priority valve only occur under parallel operation of both the blower and the operator, as in all other cases the priority valve is in the open end position for a continuous operation of the blower.

The valve 16 may be actuated as well by a hydraulic or electrohydraulic valve regulator in the operator circuit 13. This has the advantage that the blower speed is only reduced when operators requiring a high flow volume are actuated.

I claim:

1. A hydraulic system for hydraulic operating machinery for delivering pressurized fluid to a blower drive means and to a hydraulic operator circuit, comprising a variable displacement pump an-d control valves connecting said pump to said operator circuit and to said blower drive means, further comprising a temperature responsive pressure valve which is arranged in a control pressure line extending between the blower drive means and the respective control valve, said pressure valve setting a control pressure therein proportional to the temperature, wherein the control pressure line is connected to the blower drive means control valve in a sense to open it, characterized in that a control pressure valve is arranged between the control pressure line and a reservoir which control pressure valve is switched from a blocking position into a throttling position by a load pressure of the operator circuit when the operator circuit is actuated, in which throttling position the control pressure is diminished to a value for adjusting the blower drive means control valve such that a minimum speed of the blower drive means is set independent of the operator load, and comprising a regulator for the variable displacement pump which regulator receives through a load sensing line the higher of said load pressure or said control pressure.

2. The system of claim 1 wherein the control pressure valve is a 2/2 way directional valve.

3. The system of claim 1, wherein the control pressure line is connected to the blower pressure line via an orifice.

4. The system of claim 1, wherein the regulator of the variable displacement pump comprises a flow volume and a pressure regulator.

5. The system of claim 1, wherein the blower drive means control valve is a pressure compensating valve which is subjected by the control pressure towards opening and by the load pressure of the blower driver means towards closing.

6. The system of claim 1, wherein the blower drive means control valve is a directional proportional valve acting as a priority valve which is engaged by the temperature responsive control pressure towards a position connecting the pump pressure line to the control pressure line for the blower drive means and which is subjected by the load pressure of the blower drive means towards a position connecting the pump pressure line to the operator circuit to distribute the flow volume delivered by the variable displacement pump between the operator circuit and the blower circuit.

* * * * *